United States Patent [19]

Hauptman

[11] 4,095,521

[45] Jun. 20, 1978

[54] TRASH COMPACTION APPARATUS

[76] Inventor: Arthur Hauptman, 629 E. 82nd St., Brooklyn, N.Y. 11236

[21] Appl. No.: 666,777

[22] Filed: Mar. 15, 1976

[51] Int. Cl.[2] ..... B30B 1/04

[52] U.S. Cl. ..... 100/219; 100/229 A; 100/266; 100/274; 100/295

[58] Field of Search ..... 100/229 A, 266, 274, 100/275, 276, 277, 295, 240, 245, 226, DIG. 15, 219

[56] References Cited

U.S. PATENT DOCUMENTS

| | | | |
|---|---|---|---|
| 109,897 | 12/1870 | Haynie | 100/274 |
| 919,720 | 4/1909 | Heagerty | 100/266 X |
| 1,306,571 | 6/1919 | Abele | 100/219 |
| 1,388,201 | 8/1921 | Price | 100/266 |
| 2,970,533 | 2/1961 | Allen | 100/226 |
| 3,357,346 | 12/1967 | Crafoord | 100/229 A |
| 3,839,954 | 10/1974 | Bourgeois | 100/229 A |

*Primary Examiner*—Billy J. Wilhite
*Attorney, Agent, or Firm*—Philip D. Amins

[57] ABSTRACT

This disclosure pertains to apparatus for compacting trash comprising a compactor head and a portable refuse container having an open upper end positionable below and in substantially vertical alignment with the head. A foot operated treadle, when reciprocally manipulated, causes a relative joining motion between the head and the trash disposed within the confines of the container thereby compressing the trash. A release mechanism disengages the head and the container permitting the container and the head to be separated and the removal of the container from below the head; thereafter, more waste may be inserted in the container.

10 Claims, 9 Drawing Figures

FIG. 3
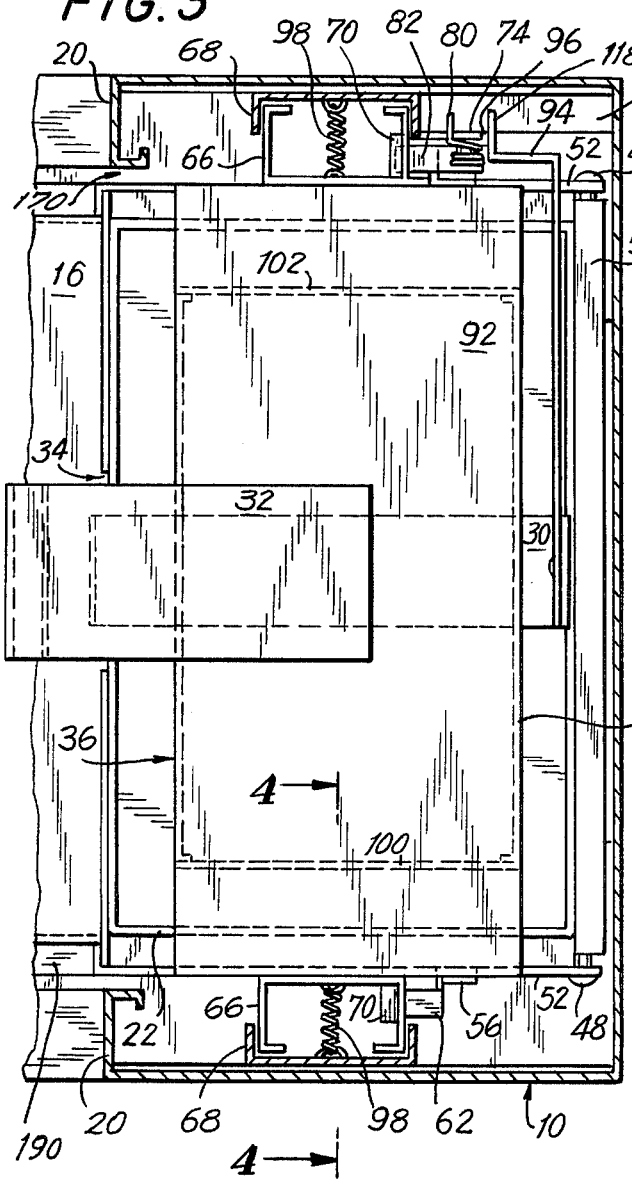
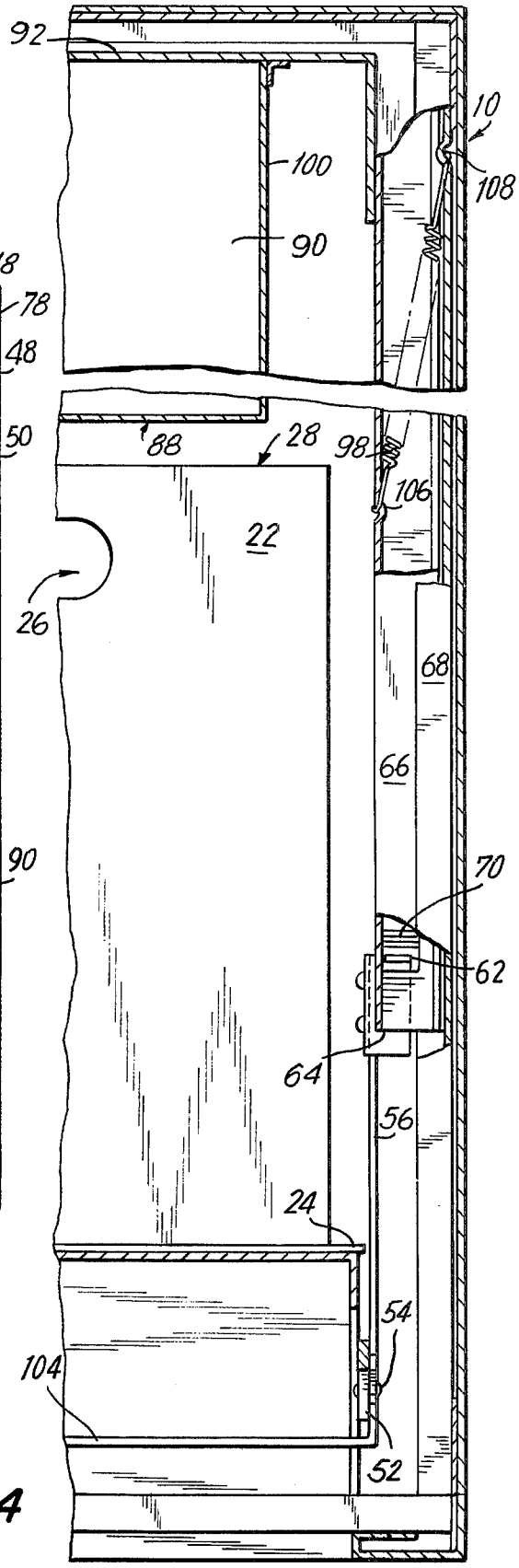
FIG. 4

TRASH COMPACTION APPARATUS

BACKGROUND OF THE INVENTION

1. The Field of the Invention

This invention relates to trash compaction devices and more particularly to that class utilizing pedally applied forces to obtain the necessary motive power for the movable platen thereof.

2. Description of the Prior Art

The prior art abounds with refuse compactors having varied compression force mechanisms and trash refuse containers. U.S. Pat. No. 3,654,855 issued on Apr. 11, 1972 to J. F. Longo teaches a hydraulically operated descendable ram head compacting trash within a stationary container, utilizing household water to operate the ram. Similarly, U.S. Pat. No. 3,683,795 issued Aug. 15, 1972 to L. C. Harris discloses a basket containing trash which is urged toward a stationary head, utilizing water pressure therefor. U.S. Pat. No. 3,528,366 issued on Sept. 15, 1970 to K. Neuenburg teaches an unlined container urged in the direction of a quasi-stationary head utilizing elevating means to urge the container towards the head. U.S. Pat. No. 3,537,390 issued on Nov. 3, 1970 to L. H. Hinkel et al discloses a refuse compactor utilizing a lined container operated as a drawer which may be disposed below a vertically descending head during a compaction mode or outwardly from thereunder during a trash loading or trash unloading mode. An electrical motor causes the head to be operated in either direction utilizing a pair of rotating lead screws therefor.

All of the aforementioned Patents suffer the common deficiency of requiring expensive and massive operating apparatus to obtain the requisite compaction forces which must be exerted between the ram head face and the trash disposed within the container. Service connections, such as electrical lines or water of pneumatic lines are also required increasing the cost of installation and, necessarily, creating an apparatus which, on the whole, is prone to frequent failure due to the complexity of its construction.

SUMMARY OF THE INVENTION

A primary object of the present invention is to provide an inexpensive foot operated trash compaction unit.

Another object is to provide a trash compaction unit which does not require electrical, pneumatic, hydraulic, or other forms of manufactured energy for its operation.

Still another object is to provide a trash compaction unit utilizing a trash container without a liner thereby permitting frequent disposal of the compacted trash without requiring the use of expensive bags or liners on each occasion that the container is emptied.

Yet another object is to provide a trash compactor which minimizes odors eminating therefrom due to its capability of being frequently and inexpensively emptied of the trash compacted therein.

A further object of the present invention is to provide a trash compactor utilizing a manually operated trip mechanism to cause the uppermost surface of the compacted trash to separate from the compactor head, thus precluding the need for complicated valves or switches otherwise required therefor.

Another object is to provide a compactor utilizing ordinary household containers of suitable size to compact the trash which is disposed therewithin.

Still another object is to provide a trash compaction unit which is light in weight and which is movable for simplicity and ease of selective placement.

Yet another object is to provide a trash compaction unit of the foregoing type which is provided with platform guidance rails which permit storage and loading of the trash container from a position within the comparator housing or a position horizontally offset therefrom.

Relatively expensive compactors utilizing electrical, pneumatic, or hydraulic forces to urge the ram head and the trash bearing container together, all require substantial space consuming complicated control and motive components therefor. The instant disclosure utilizes a foot treadle to pivot a bar so as to obtain a substantial mechanical advantage therefrom. The bar in turn engages a notched rack-like rod which is fastened to either a movable ram head or a movable container supporting platform. When the head is movable, the container rests on a stationary platform. Contrariwise, in another embodiment of this invention, when the head is stationary, the container and its supporting platform is movable upwardly, causing the container to surround the stationary ram head and compacting the trash contacted by head. Each progressive stepwise motion of the rack-like rod causes an engagement with a spring-loaded pawl maintaining the rack-like rod in its new location. Reciprocation of the foot pedal again causes a stepwise relocation of the rack-like rod. The process is repeated until the trash is compacted to the desired degree, as evidenced by the resistance detected at the foot treadle, opposing the force applied by the foot of the user. A pawl releasing lever when manually operated, causes the pawl to disengage the rack-like rod allowing the container and supporting platform to descend to a fully open position away from the stationary ram head, or, in the case of a stationary platform supporting a container and a movable ram head, causing the ram head to be returned to its original upright position.

These objects, as well as other objects of the present invention, will become more readily apparent after reading the following description of the accompanying drawings.

BRIEF DESCRIPTION OF THE DRAWINGS

FIG. 3 is a cross-sectional plan view taken along line 3—3 viewed in the direction of arrows 3—3 as shown in FIG. 2.

FIG. 4 is a front elevational cross-sectional view taken along line 4—4 viewed in the direction of arrows 4—4 as shown in FIG. 3.

DESCRIPTION OF THE PREFERRED EMBODIMENT

Figure 1:
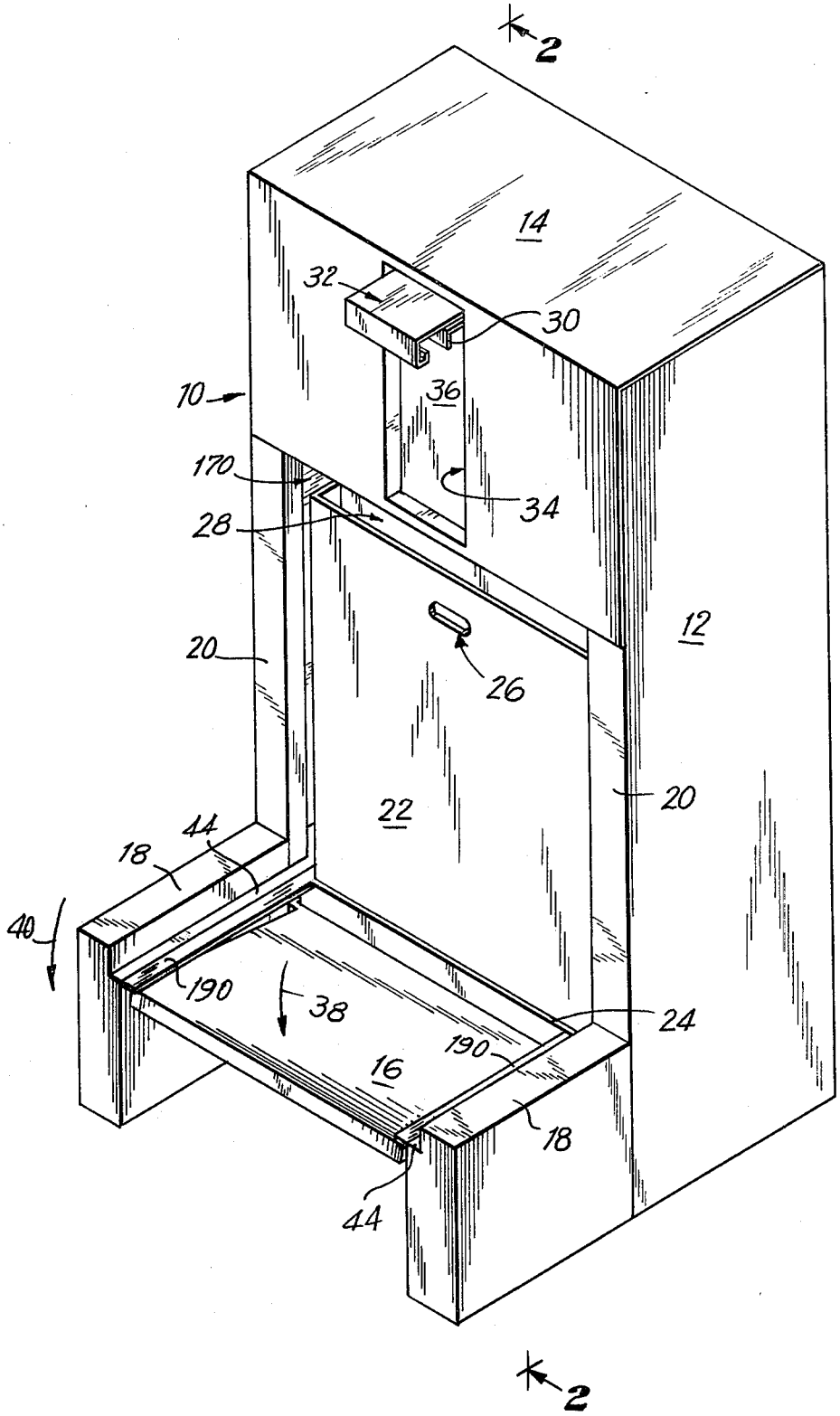
FIG. 1 is a perspective view of the exterior portions of the preferred embodiment of the present invention.

The structure and method of fabrication of the present invention is applicable to a housing surrounding a frame which bridges a ram located in the uppermost regions of the frame. A platform is secured at the lowermost regions of the frame and is utilized to support a conventional household trash container thereupon. The container is removably placed upon the platform and positioned ot that the uppermost mouth-like opening of the container is disposed below the ram head. A foot treadle extends outwardly and forwardly from beneath the bridge-like container supporting platform. A pair of outwardly extending rails provide support for the container when it is disposed above the foot treadle. The container is moved along the rails outwardly from the interior of the housing for purposes of insertion of trash into the container and removal of the container, including the compacted trash within, from the housing. The rails extend outwardly from the supporting platform. The treadle is secured to a pair of treadle pivot arms each of which is in turn co-axially pivoted to the frame. A spring urges the treadle in an uppermost rest position. A pair of pawl bearing activating arms are pivotably secured to the treadle pivot arms in such a manner that both pawl bearing activating arms act in unison projecting the pawls forwardly towards the foot treadle. The upper ram head and its associated guide rods operate vertically due to a pair of guide rod tracks which maintain the guide rods in a vertical position. Each guide rod is provided with a rack-like surface comprising a plurality of indented-like teeth extending on a rearmost vertical surface thereof. Each time the foot treadle is reciprocated from the rest position to a lowermost depressed position, the pawls, which engage the rack-like depressions, force the racks and upper ram head downwardly. The force exerted on the ram head greatly exceeds the force exerted on the foot treadle due to the mechanical advantage obtained by the pivotal location of the treadle pivot arm and the pawl bearing activating arm thereupon.

A rocker bar disposed generally vertically is pivoted about a horizontal rod secured to the frame. A latching tongue is secured to the rocker bar and extends forwardly towards the foot treadle. A spring urges the latching tongue in a forward and upward direction about the pivot rod such that the latching tongue engages the rack-like depressions in one of the guide rods, at a location slightly above the uppermost position of the associated pawl. When the pawls are lowered, by depressing the foot treadle, the latching tongue disengages from the rack, only to be re-engaged at an upper depression in the rack-like surface, upon the pawl reaching a lowermost position. When the foot treadle is released, the pawls disengage from the rack-like depressions and move upwardly until a position is found at which the pawls are set to re-engage the rack-like depressions as the foot treadle is at its uppermost rest position.

The repetitive forced depression of the foot treadle followed by a release thereof causes the upper ram head to descend incrementally due to the pawl engagement with the rack followed by the latching tongue engagement with the rack, securing the upper ram head at its now lowered position.

The user, upon detecting a satisfactory resistive force experienced upon pedal depression of the foot treadle, may permit the upper ram head and associated guide rods to return to its uppermost rest position by operating the release lever in the forward direction. The release lever is secured to a release arm, which in turn, when operated, causes the rocker bar to rotate around this pivot rod in such a manner as to release the latching tongue from the rack-like depressions. Thus, the pair of racks and the upper ram head are released for urging upwardly by the spring so utilized. When in the uppermost position, the ram head has been entirely removed from within the mouth of the container permitting the container to be withdrawn from the housng through suitable front located opening and to thereafter permit the introduction of additional trash into the container following the path including the space between the lowermost surface of the ram head and the rim adjacent the mouth of the container.

AN ALTERNATE EMBODIMENT

The alternate embodiment includes a movable container supporting platform and a stationary ram head. The platform is provided with a pair of vertical guide rods, each of which is adapted with rack-like teeth. The guide rods are in turn supported on vertical tracks enabling the general upward and downward displacement of the guide rods and the container supporting platform affixed thereto. A foot treadle, when reciprocated, operates a pair of activating arms into selective engagement with the rack-like teeth, causing the platform to ascend as the foot treadle is lowered. A latching tongue, rocker bar, spring, and pivot rod are utilized to selectively engage the rack-like teeth so as to maintain the platform in an uppermost position following each successful depression of the treadle. The activating arm, biased inwardly towards the rack-like teeth, disengages therefrom as the foot treadle is released from its lowermost position and is allowed to ascend to the rest position. The activating arm re-engages the rack-like teeth preparatory to the next depression of the foot treadle. The trash compacting process continues as the base of the trash container is urged upwardly towards the stationary ram head, extending through the mouth of the container. Pivoting the rocker arm about its pivot rod, so as to overcome the rocker arm spring forces, causes the latching tongue to disengage from the rack-like teeth, allowing the container supporting platform and the container to descend. The container may then be removed laterally from under the stationary head, if desired. Since the head is displaced above the mouth of the container when the latching tongue is removed from the rack-like teeth, additional trash may be introduced into the container in this position, or the container may be removed laterally for the subsequent introduction of trash therein.

Now referring to the Figures, and more particularly to the preferred embodiment, there is illustrated in FIG. 1 an enclosure 10 including a side panel 12 and a top panel 14 thereof. Foot treadle 16 is shown positioned between a pair of foot treadle side columns 18 extending outwardly and forwardly from front panels 20. Trash container 22 is shown resting upon platform 24, and is provided with a hand grasping opening 26 located adjacent a mouth portion 28 thereof. Release lever 30 is positioned below release bar 32. Both the release lever and the release bar are permitted to move downwardly in slot 34 from the position shown, as the ram front gusset plate 36, partially viewed through slot 34, is urged into mouth portion 28 of container 22. A force applied in the direction of arrow 38 to foot treadle 16, causes the treadle to move downwardly of arrow 40. Rail 190 extends across the depth of treadle side columns 18, providing support for container 22, supported thereon, when manually disposed outwardly from housing 12 and forwardly from front panels 20. Trash may be loaded into container 22 through mouth portion 28 when container 22 is in this position.

Foot treadle side columns 18 extend forwardly and outwardly of enclosure 10 so as to provide a deepened lateral support for the instant invention. The L-shaped cross-section comprising side panels 12 and the co-planar side panel of foot treadle side columns 18 prevent tipping of the enclosure when foot treadle 16 is forcefully depressed. Side columns 18 also serve to protect against inadvertant contact with the side faces of foot treadle 16.

Figure 2:
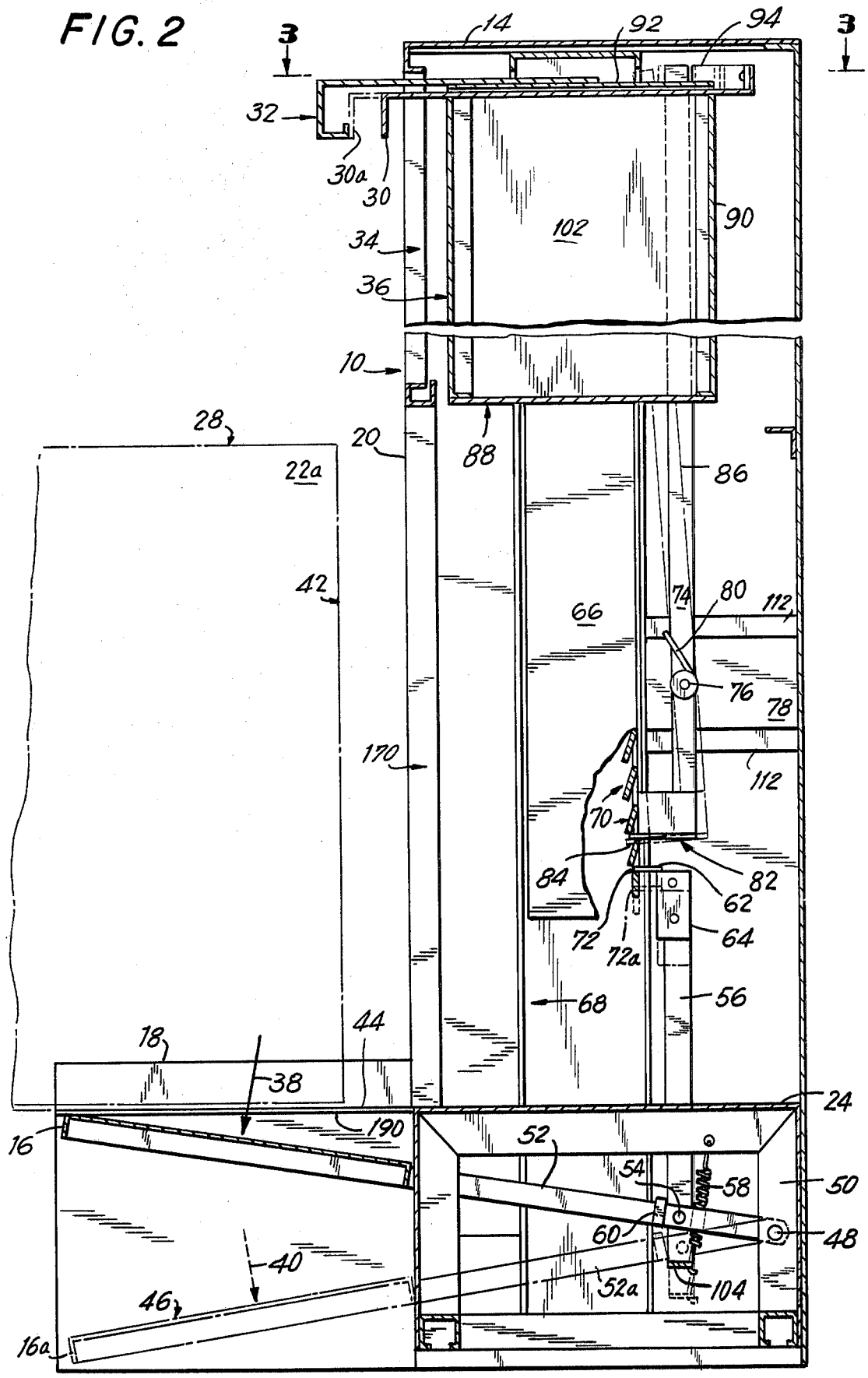
FIG. 2 is a side elevation view of the interior apparatus.

FIG. 2 illustrates container 22, as shown in FIG. 1, removed from within enclosure 10, denoted as 22*a* by dotted lines 42. Container 22*a* is shown resting on lip 44 which extends inwardly from foot treadle side column 18. When the container is included within housing 10, support is provided by container supporting platform 24.

Foot treadle 16 when urged in the direction of arrow 40 by a pedally applied force in the direction of arrow 38 attains the lowermost position 16*a* denoted by dotted lines 46. Foot treadle pivot rod 48 extends horizontally from container supporting platform bridge framework member 50 and is used to pivotably support treadle pivot arm 52. Thus, treadle 16 pivots around foot treadle pivot rod 48. Activating arm pivot rod 54 pivotably secures activating arm 56 to treadle pivot arm 52. Activating arm spring 58 causes the upper end of activating arm pivot rod 54. Cam 60 prevents the unlimited rotation of activating arm 56 about activating arm pivot rod 54. Pawl 62 is secured to the uppermost end of activating arm 56 utilizing bracket 64 therefor. Guide rod 66 is included within track 68 and is free to move in a vertical direction therealong. Racklike teeth 70 extend along the length of guide rod 66. Pawl 62 engages teeth 70 in the position shown at point 72. When treadle 16 is moved downwardly into position 16*a*, point 72 is lowered to point 72*a* as well as treadle pivot arm 52 being moved into the position denoted as 52*a*. It is at this time that guide rod 66 is urged downwardly. Rocker bar 74 is pivoted about rocker bar pivot rod 76 which extends normally from mounting bracket 78. Rocker bar spring 80 urges the lowermost portions of rocker bar 74 in a clockwise direction causing latching tongue 82, affixed at one end of rocker bar 74 to engage one of teeth 70 at point 84. Dotted lines 86 indicate the position of rocker bar 74 when latching tongue 82 is disengaged from teeth 70 at point 84. Trash contacting head plate 88, ram front gusset plate 36 and ram rear gusset plate 90 are secured to guide rod 66 and move concurrently in the vertical direction therewith. Similarly, release bar 32 and release lever 30 move downwardly with dead plate 88. Release bar 32 is fixedly secured to ram cover plate 92 whilst release lever 30 is movable horizontally below ram cover plate 92. When release lever 30 is manually urged forwardly, by a relative compressive action between release lever 30 and release bar 32, employing a finger grasping motion by the user thereon, release arm 94 is similarly urged forwardly contacting the uppermost regions of rocker bar 74, causing the same to rotate counterclockwise about rocker bar pivot rod 76 allowing latching tongue 82 to disengage from teeth 70. Thus, guide rod 66, head plate 88, ram front gusset plate 36, ram rear gusset plate 90, ram cover plate 92, release lever 30, and release bar 32 are all allowed to move upwardly. It is to be noted that when treadle 16 is in an uppermost position, as shown in FIG. 2, cam 60 also serves to move activating arm 56 to a laterally offset position from a completely vertical orientation, thereby preventing undersirable subsequent engagement of pawl 62 with teeth 70. The ends of release bar 32 and release lever 30 are allowed to extend through slot 34 whose elongated length permits release lever 30 and release bar 32 to freely extend along their vertical excursion when head plate 88 enters mouth portion 28 of container 22, as shown in FIG. 1.

Container 22 passes through an opening 170 adjacent front panels 20 permitting the container to rest upon container supporting platform 24.

FIG. 3 illustrates ram cover plate 92 upon which release bar 32 is secured. Release lever 30, partially concealed by cover plate 92 and release bar 32, is fixedly secured to release arm 94. Rocker bar 74 engages release arm 94 at point 96 when release lever 30 is urged leftwardly, so as to free latching tongue 82 from the teeth located in the rearmost vertical surface of guide rod 66. Spring 80 resists the disengagement. Springs 98 urge or assist guide rods 66 upwardly as well as ram front gusset plate 36, ram rear gusset plate 90, and ram gusset side plates 100 and 102. Head plate 88, shown in FIG. 2, is bounded by ram front gusset plate 36, ram rear gusset plate 90, and ram gusset side plates 100 and 102 facilitating the entry within container 22, shown herein in place in enclosure 10. Tracks 68 are shown secured to the inner side walls and the framework of enclosure 10 facilitating the vertical travel of guide rods 66 and the associated arm head components. Treadle pivot arms 52 are shown pivoted to container supporting platform bridge framework member 50 utilizing co-axially aligned pivot rods 48. Pawls 62 extending from activating arm 56 are shown engaged within teeth 70.

FIG. 4 shows container 22 residing on platform 24. Head plate 88 is shown poised above mouth portion 28 preparatory to guide rod 66 being urged downwardly along track 68 utilizing pawl 62 when engaged within teeth 70 therefor. Activating arm 56 is pivotably connected to treadle pivot arm 52 utilizing activating arm pivot rod 54 therefor. Arm 104 connects to the other activating arm 56, not shown. Spring 98 is confined within guide rod 66 and is fastened thereto at point 106 and to the upper portion of track 68 at point 108.

Figure 5:
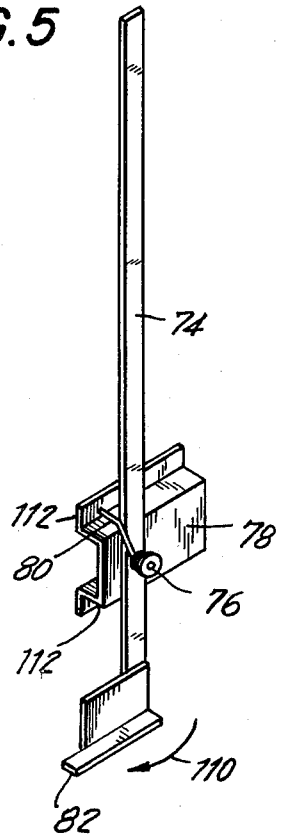
FIG. 5 is a perspective view of the spring biased latching tongue and rocker bar pivotably secured to its mounting bracket.

FIG. 5 depicts mounting bracket 78 to which is secured rocker bar pivot rod 76. Rocker bar 74 pivots about rocker bar pivot rod 76 utilizing rocker bar spring 80 to cause latching tongue 82 to be urged in the direction of arrow 110. Lips 112 of mounting bracket 78 are secured to the interior surface of enclosure 10.

Figure 6:
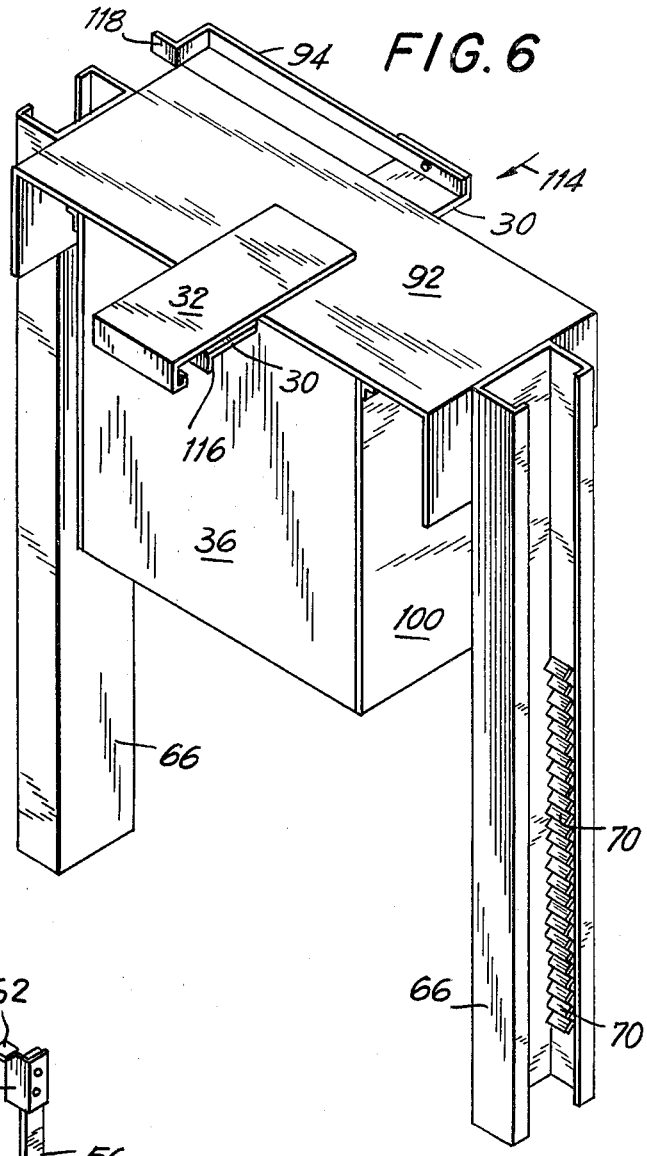
FIG. 6 is a perspective view of the upper ram head, release bar and lever, rack, and guide rods.

FIG. 6 illustrates ram front gusset plate 36 and ram gusset side plate 100 secured normally to cover plate 92. Release bar 32 is fastened to ram cover plate 92. Release lever 30 is positioned below the lowermost surface of cover plate 92 and may be urged in the direction of arrow 114 by a force applied to lip 116 of release lever 30. Release arm 94 is simultaneously similarly urged in the direction of arrow 114 permitting surface 118 to contact the uppermost area of rocker bar 74 shown in FIG. 5 and urging latching tongue 82 to move in a direction counter to arrow 110. Tracks 66 are secured to ram cover plate 92, and have teeth 70 on their rearmost vertical surfaces.

Figure 7:
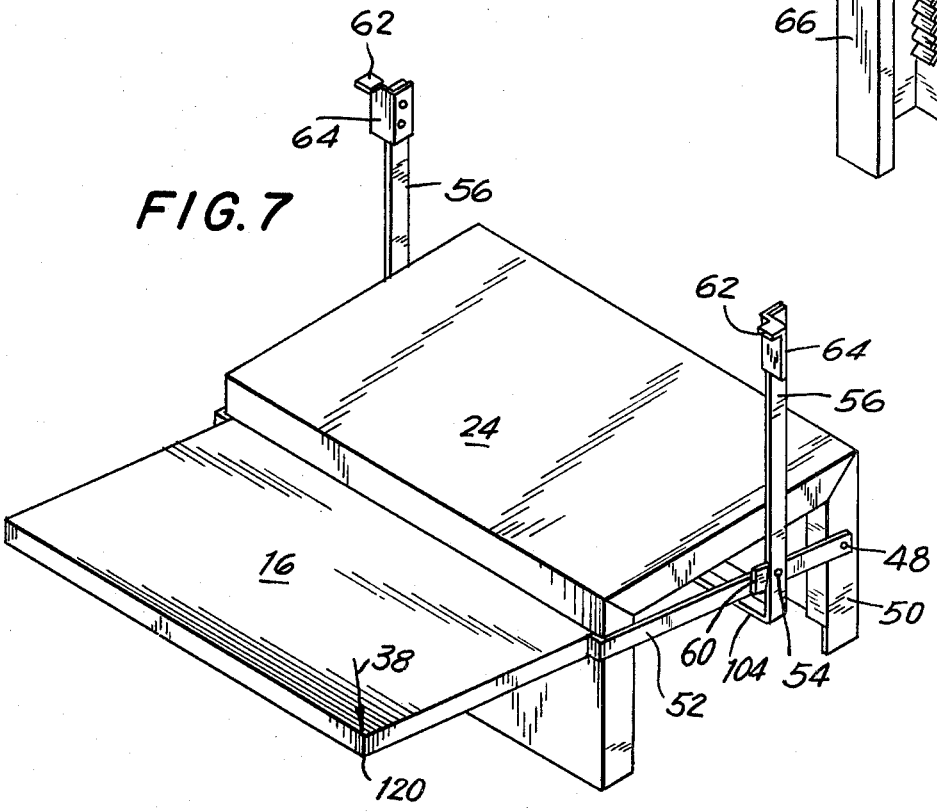
FIG. 7 is a perspective view of the container supporting platform, foot treadle, and pawl bearing activating arms.

FIG. 7 illustrates platform 24 supported by container supporting platform bridge framework member 50. Pivot arm 52 of treadle 16 is offset with respect thereto and is pivoted to framework member 50 at pivot rod 48. Arm 104 connects both activating arms 56 at the co-axially aligned activating arm pivot rod 54 secured to treadle pivot arm 52. Point 120 on treadle 16 is a greater distance from foot treadle pivot rod 48 than the distance separating activating arm pivot rod 54 from pivot rod 48. Thus a force applied at point 120, in the direction of arrow 38, has a mechanical advantage of the ratios of the distances separating point 120 from foot treadle pivot rod 48 to the distance separating activating arm pivot rod 54 from foot treadle pivot rod 48. The downwardly applied forces utilizing pawls 62 on teeth 70, shown in FIG. 6, are the equivalent of the pedally applied forces, applied in the direction of arrow 38, amplified by the mechanical advantage.

Figure 8:
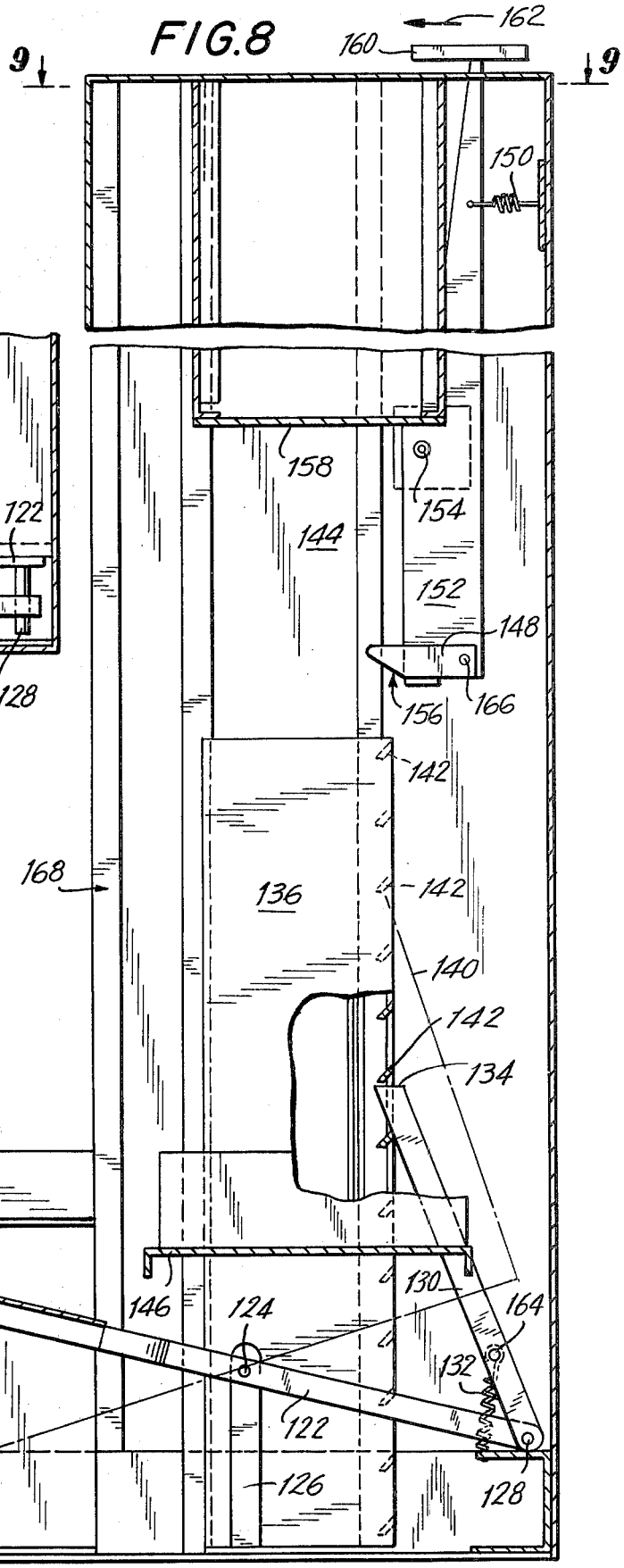
FIG. 8 is a side elevation view of the alternate embodiment of the instant invention.

FIG. 8 is a side elevation cutaway view of the alternate embodiment of the instant invention showing foot treadle **16*a* in its uppermost position affixed to treadle pivot arm 122. Foot treadle pivot rod 124 is fixedly secured to support column 126 fastened adjacent an interior wall of the enclosure. Activating arm pivot rod 128 pivotably secures activating arm 130 to treadle pivot arm 122. Activating arm spring 132 biases the uppermost tooth engaging surface 134 in a counterclockwise direction enabling uppermost tooth engaging surface 134 to enter openings in guide rod 136. When treadle 16*a* is operated in the direction of arrow 138, uppermost tooth engaging surface 134 assumes the position indicated by dotted line 140 causing uppermost tooth engaging surface 134 to force teeth-like surfaces 142** in an upward direction.

Guide rod 136 is guided along track 144 allowing platform 146 to move upwardly therewith. A point will be reached, during the upward translation of guide rod 136 and platform 146 so that latching tongue 148 will engage an uppermost toothlike surface 142 and reside thereunder due to the clockwise rotational translation imparted by rocker bar spring 150 thereupon. Rocker bar 152 is pivoted about rocker bar pivot rod 154. Ramped surface 156 of latching tongue 148 causes latching tongue 148 to move in the clockwise direction about pivot rod 166 as each tooth-like surface 142 is traversed thereby. A depression of treadle **16*a* causes a stepwise upward motion of guide rod 136 and platform 146. Latching tongue 138 will engage one of tooth-like surfaces 142 near the uppermost position of each stepwise vertical excursion of guide rod 136, retaining guide rod 136 and platform 146 at the elevated position awaiting another operation of treadle 16*a* in the direction of arrow 138. A waste container, not shown, residing on platform 146, having been passed through an opening 168 in the enclosure, will move upwardly as guide rod 136 is transported in the vertical direction. Stationary head plate 158** is utilized to compact the trash, not shown, within the waste container, not shown.

When handle 160 is urged in the direction of arrow 162, latching tongue 148 is disengaged from teeth-like surfaces 142, allowing gravity to permit guide rod 136 and platform 146 and the waste container residing thereon to descend.

Figure 9:
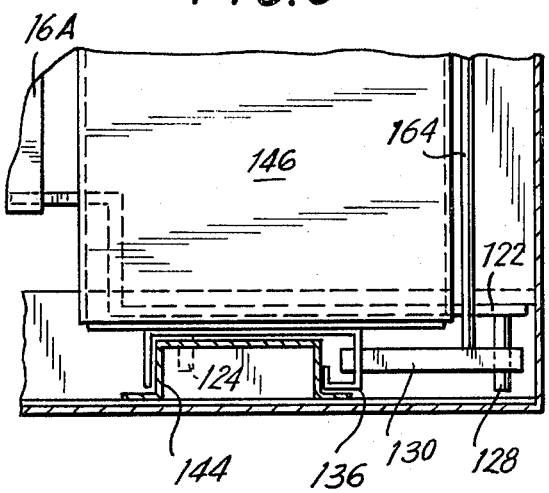
FIG. 9 is a cross-sectional plan view taken along line 9—9 viewed in the direction of arrows 9—9 as shown in FIG. 8.

FIG. 9 shows treadle **16*a* utilizing offset treadle pivot arm 122 to operate activating arm 130. Rod 164 connects to the other activating arm 130, not shown, to facilitate the joint movement with the activating arm 130** illustrated herein.

One of the advantages is an inexpensive foot operated trash compaction unit.

Another advantage is a trash compaction unit which does not require electrical, pneumatic, hydraulic, or other forms of manufactured energy for its operation.

Still another advantage is a compaction unit utilizing a trash container without a liner thereby permitting frequent disposal of the compacted trash without requiring the use of expensive bags or liners on each occasion that the container is emptied.

Yet another advantage is a trash compactor which minimizes odors eminating therefrom due to its capability of being frequently and inexpensively emptied of the trash compacted therein.

A further advantage is a trash compactor utilizing a manually operated trip mechanism to cause the uppermost surface of the compacted trash to separate from the compacting head, thus precluding the need for complicated valves or switches otherwise required therefor.

Another advantage is a compactor utilizing ordinary household containers of proper size to compact the trash which is disposed therewithin.

Still another advantage is a trash compaction unit which is light in weight and which is movable for simplicity and ease of selective placement.

Yet another advantage is a trash compaction unit of the foregoing type which is provided with platform guidance rails which permits storage and loading of the trash container from a position within the compactor housing or a position horizontally offset therefrom.

Thus, there is disclosed in the above description and in the drawings, embodiments of the invention which fully and effectively accomplish the objects therof. However, it will be readily apparent to those skilled in the art, that there are modifications, changes, and improvements which can be made herein, without departing from the spirit and scope of the invention. Therefore, the present invention is not to be limited by the specific disclosure herein, but only by the appending claims.

I claim:

1. A trash compaction apparatus comprising a container for the storage of trash therein, said container having an open mouth, a housing, an opening in said housing, said opening permitting the passage of said container therethrough, a ram head, said ram head being disposed within said housing, said open mouth being in substantial vertical alignment with said ram head, a foot operated treadle, said ram head being capable of displacement along a vertical line, said ram head being disposed in an uppermost position, ram head displacement means for applying an urging force for displacing said ram head from said uppermost position downwardly through said mouth and into said container in compressive touching engagement with said trash in a trash contacting position, said urging force being derived from the application of downward manual forces applied to said foot operated treadle, latching means for retaining said ram at selective locations intermediate said uppermost position and said trash contacting position, ram head upward biasing means for urging said ram head into said uppermost position, unlatching means for releasing said latching means, guidance means for guiding said ram head along said vertical line, said guidance means including a track and a guide rod, said track being fixedly secured to the interior of said housing, said guide rod being disposed within said housing and fixedly secured to said ram head, said guide rod being disposed in sliding engagement with said track, said ram head displacement means comprising a plurality of rack-like teeth, said plurality of rack-like teeth being disposed in spaced apart relationship along a vertical surface of said guide rod, a pawl, said pawl being disposed in selective touching engagement with at least one of said plurality of rack-like teeth, pawl biasing means for biasing said pawl in said selective touching engagement, an arm pivotably secured to said foot operated treadle, said pawl fixedly secured to said arm, and mechanical advantage means for applying a greater downward force upon said at least one of said plurality of rack-like teeth by said pawl than said downward manual forces applied to said foot operated treadle.

2. The trash compaction apparatus in accordance with claim 1, wherein said pawl biasing means comprises a first spring, one end of said first spring being secured to said housing, and the other end of said first spring being secured to said arm.

3. The trash compaction apparatus in accordance with claim 1, wherein said mechanical advantage means comprises a pivot rod, a treadle support bar, said foot operated treadle being fixedly secured to one end of said treadle support bar, the other end of said treadle support bar being pivotably secured to said housing, said pivot rod being fixedly secured to said treadle support bar intermediate said one end and said other end thereof, and said arm being pivotably secured to said pivot rod.

4. The trash compaction apparatus in accordance with claim 3, further comprising a container supporting platform, said container supporting platform being fixedly secured to said housing, and said foot operated treadle and said treadle support bar being disposed below a plane defined by said container supporting platform.

5. The trash compaction apparatus in accordance with claim 4, further comprising a rail, said rail extending outwardly of said housing, said container being disposed on said rail when said container is manually positioned outwardly of said housing, and said rail supporting said container being coextensive with said plane when said container is disposed outwardly of said housing.

6. The trash compaction apparatus in accordance with claim 1, wherein said latching means comprises a latching tongue, a latching tongue supporting rocker bar, said latching tongue fixedly secured to one end of said latching tongue supporting rocker bar, a latching tongue supporting rocker bar pivot rod, said latching tongue supporting rocker bar pivot rod fixedly secured to said interior of said housing and extending inwardly therefrom, said latching tongue supporting rocker bar pivotably secured to said latching tongue supporting rocker bar pivot rod, latching tongue supporting rocker bar bias means for urging said latching tongue towards said plurality of racklike teeth, said latching tongue is selective latching touching engagement with at least another one of said plurality of rack-like teeth, said at least another one of said plurality of rack-like teeth being disposed above said at least one of said plurality of rack-like teeth, and said latching tongue preventing unlimited upward motion of said ram head and said guide rod when in said selective latching touching engagement with said at least another one of said plurality of rack-like teeth.

7. The trash compaction apparatus in accordance with claim 6, wherein said latching tongue supporting rocker bar bias means comprises a second spring, said second spring being disposed around said latching tongue supporting rocker bar pivot rod, and one end of said second spring in touching engagement with said latching tongue supporting rocker bar.

8. The trash compaction apparatus in accordance with claim 7, wherein said ram head upwardly biasing means comprises a third spring, one end of said third spring being secured to said housing, and the other end of said third spring being secured to said guide rod.

9. The trash compaction apparatus in accordance with claim 6, wherein said unlatching means comprises a plate, said plate being disposed passing through said ram head, said plate for manual urging in a direction normal to the edges of said container defining said open mouth, another opening in said housing, one end of said plate being disposed extending outwardly through said another opening, a latching tongue supporting rocker bar activating arm, said latching tongue supporting rocker bar activating arm fixedly secured to the other end of said plate, and said latching tongue being disengaged from said at least another one of said plurality of rack-like teeth upon said one end of said plate being manually urged in the outward direction from said housing.

10. A trash compaction apparatus comprising a container for the storage of trash therein, said container having an open mouth, a housing, an opening in said housing, said opening permitting the passage of said container therethrough, a ram head, said ram head being disposed within said housing, said open mouth being in substantial vertical alignment with said ram head, a foot operated treadle, said ram head being capable of displacement along a vertical line, said ram head being disposed in an uppermost position, ram head displacement means for applying an urging force for displacing said ram head from said uppermost position downwardly through said open mouth and into said container in compressive touching engagement with said trash in a trash contacting position, said urging forces being derived from the application of downward manual forces applied to said foot operated treadle, latching means for retaining said ram at selective locations intermediate said uppermost position and said trash contacting position, ram head upward biasing means for urging said ram head into said uppermost position, unlatching means for releasing said latching means, guidance means for guiding said ram head along said vertical line, said guidance means including a track and a guide rod, said track being fixedly secured to the interior of said housing, said guide rod being disposed within said housing and fixedly secured to said ram head, said guide rod being disposed in sliding engagement with said track, a plurality of rack-like teeth, said plurality of rack-like teeth being disposed in spaced apart relationship along a vertical surface of said guide rod, a pawl, said pawl being disposed in selective touching engagement with at least one of said plurality of rack-like teeth, pawl biasing means for biasing said pawl in said selective touching engagement, an arm pivotably secured to said foot operated treadle, said pawl fixedly secured to said arm, mechanical advantage means for applying a greater downward force upon said at least one of said plurality of rack-like teeth by said pawl than said downward manual forces applied to said foot operated treadle, said pawl biasing means includes a first spring, one end of said first spring being secured to said housing, the other end of said first spring being secured to said arm, said mechanical advantage means includes a pivot rod, a treadle support bar, said foot operated treadle being fixedly secured to one end of said treadle support bar, the other end of said treadle support bar being pivotably secured to said housing, said pivot rod being fixedly secured to said treadle support bar intermediate said one end and said other end thereof, said arm being pivotably secured to said pivot rod, a container supporting platform, said container supporting platform being fixedly secured to said housing, said foot operated treadle and said treadle support bar being disposed below a plane defined by said container supporting platform, said foot operated treadle being disposed outwardly from said housing, said latching means includes a latching tongue, a latching tongue supporting rocker bar, said latching tongue fixedly secured to one end of said latching tongue supporting rocker bar, a latching tongue supporting rocker bar pivot rod, said latching tongue supporting rocker bar pivot rod fixedly secured to said interior of said housing and extending inwardly therefrom, said latching tongue supporting rocker bar pivotably secured to said latching tongue supporting rocker bar pivot rod, latching tongue supporting rocker bar bias means for urging said latching tongue towards said plurality of rack-like teeth, said latching tongue in selective latching touching engagement with at least another one of said plurality of rack-like teeth, said at least another one of said plurality of rack-like teeth being disposed above said at least one of said plurality of rack-like teeth, said latching tongue preventing unlimited upward motion of said ram head and said guide rod when in said selective latching touching engagement with said at least another one of said plurality of rack-like teeth, said latching tongue supporting rocker bar bias means includes a second spring, said second spring being disposed around said latching tongue supporting rocker bar pivot rod, one end of said second spring in touching engagement with said latching tongue supporting rocker bar, said ram head upwardly biasing means includes a third spring, one end of said third spring being secured to said housing, the other end of said third spring being secured to said guide rod, said unlatching means includes a plate, said plate being disposed passing through said ram head, said plate for manual urging in a direction normal to the edges of said container defining said open mouth, another opening in said housing, one end of said plate being exposed extending outwardly through said another opening, a latching tongue supporting rocker bar activating arm, said latching tongue supporting rocker bar activating arm fixedly secured to the other end of said plate, said latching tongue being disengaged from said at least another one of said plurality of rack-like teeth upon said one end of said plate being manually urged in the outward direction from said housing, a rail, said rail extending outwardly of said housing, said container being disposed on said rail when said container is manually positioned outwardly of said housing, said rail supporting said container being coextensive with said plane when said container is disposed outwardly of said housing, said housing having an L-shaped cross-section, and the horizontal member of said L-shaped cross-section being disposed adjacent to said foot operated treadle and providing lateral support to said housing.

* * * * *